US005373129A

United States Patent [19]

Shutoh et al.

[11] Patent Number: 5,373,129

[45] Date of Patent: Dec. 13, 1994

[54] POWER CIRCUIT BREAKER AND POWER RESISTOR

[75] Inventors: Naoki Shutoh, Yokohama; Motomasa Imai, Tokyo; Fumio Ueno, Yokohama, all of Japan

[73] Assignee: Kabushiki Kaisha Toshiba, Kawasaki, Japan

[21] Appl. No.: 28,284

[22] Filed: Mar. 9, 1993

[30] Foreign Application Priority Data

Mar. 12, 1992 [JP] Japan ..... 4-053537

[51] Int. Cl.[5] ..... H01H 33/16

[52] U.S. Cl. ..... 200/144 AP; 200/144 R

[58] Field of Search ..... 200/144 R, 144 AP; 338/20, 21

[56] References Cited

U.S. PATENT DOCUMENTS

| | | | |
|---|---|---|---|
| 2,892,988 | 6/1959 | Schusterius et al. . | |
| 4,265,844 | 5/1981 | Yokomizo et al. | 264/61 |
| 4,420,737 | 12/1983 | Miyoshi et al. | 338/21 |
| 4,943,795 | 7/1990 | Yamazaki et al. | 338/21 |

FOREIGN PATENT DOCUMENTS 63-90801 4/1988 Japan .

OTHER PUBLICATIONS

PRY, et al., Solid-State Electronics, vol. 6, 1963, pp. 111-120. "Positive Temperature Coefficient of Electrical Resistivity in Some $ZnO-TiO_2-NiO$ Ceramics".

*Primary Examiner*—A. D. Pellinen
*Assistant Examiner*—Michael A. Friedhofer
*Attorney, Agent, or Firm*—Oblon, Spivak, McClelland, Maier, & Neustadt

[57] ABSTRACT

A compact power circuit breaker having a large breaking capacity and stable breaking performance by using a compact closing resistor unit having high performance. The power circuit breaker includes a main switch arranged in a current path, an auxiliary switch connected to the current path parallel with respect to the main switch and turned on prior to an ON state of the main switch, and a closing resistor unit connected in series with the auxiliary switch and incorporated with a resistor having a sintered body consisting of a Zn—Ti—Co—O—based oxide and having metal components consisting of titanium calculated as titanium oxide ($TiO_2$) in an amount of 0.5 to 25 mol %, cobalt calculated as cobalt oxide (CoO) in an amount of 0.5 to 30 mol %, and Zn as substantially the balance.

11 Claims, 4 Drawing Sheets

POWER CIRCUIT BREAKER AND POWER RESISTOR

BACKGROUND OF THE INVENTION

1. Field of the Invention

The present invention relates to a power circuit breaker and a power resistor suitable for absorbing a surge generated by power equipments such as a voltage transformer and a circuit breaker.

2. Description of the Related Art

A closing resistor is generally connected to a power circuit breaker parallelly to a breaking connection point to absorb a surge generated during a switching operation and to increase a breaking capacity. As a resistor used for the above purpose, a carbon grain dispersion ceramic resistor described in Published Unexamined Japanese Patent Application No. 58-139401 is conventionally used. The resistor is obtained by dispersing a conductive carbon powder in an insulating aluminum oxide crystal and sintering them by a clay. The resistor has a resistivity of 100 to 2,500Ω·cm. The resistivity to the resistor can be advantageously changed by controlling the content of the carbon powder. However, since the resistor has low denseness, i.e., a porosity of 10 to 30%, the following problems are posed.

That is, since a heat capacity per unit volume is small, i.e., about 2 J/cm$^3$·deg, the temperature of the resistor is remarkably increased in accordance with heat generation caused by surge absorption. In addition, since a discharge is caused between carbon grains during absorption of a switching surge, or the resistor has a negative temperature coefficient of resistance, the resistor is easily punched through and broken, and an energy breakdown is decreased. In addition, when the resistor is exposed at a high temperature, carbon grains for controlling the resistance are oxidized. For this reason, the resistance is largely changed. Therefore, in the circuit breaker using a carbon grain dispersion ceramic resistor, a space for storing the resistor is increased, and a breaking capacity must be suppressed to be small to secure the reliability of the circuit breaker.

In recent years, in accordance with an increase in capacity of a circuit breaker caused by the technical development, a high-performance closing resistor for absorbing a switching surge is strongly demanded. In order to cope with the above demand, a zinc oxide-aluminum oxide powder resistor is disclosed in Published Unexamined Japanese Patent Application No. 61-281501, and a zinc oxide-magnesium oxide powder resistor is disclosed in Published Unexamined Japanese Patent Application No. 63-55904. In these patent applications, the following advantages are described. That is, since each of these resistors has a relatively high surge breakdown and a positive temperature coefficient of resistance, the resistor has excellent characteristics, i.e., the resistor is not easily over run. However, each of the resistors is not easily formed by a highly dense sintered body, and the production stability and the stability against a change in atmosphere are not satisfied. In addition, a heat capacity per unit volume cannot be increased. As a result, in the circuit breaker using each of these resistors, a large space is required for storing the resistor, and the breaking capacity must be suppressed to be small to secure the reliability of the circuit breaker.

In Solid-State Electronics Pergamon Press 6, 111 (1963), U.S. Pat No. 2,892,988, and U.S. Pat. No. 2,933,586, zinc oxide resistors are disclosed. In these publications, the resistivity of each of these zinc oxide resistors can be controlled within a wide range by changing contents of additives such nickel oxide (NiO) and titanium oxide ($TiO_2$) to zinc oxide contained in a ceramic. In addition, a temperature coefficient of resistance can be changed within a range from a negative value to a positive value. However, the application and performance of the resistors which are used as power resistors are not disclosed, and the application of the resistors to a circuit breaker as a closing resistor is not disclosed.

SUMMARY OF THE INVENTION

It is an object of the present invention to provide a compact power circuit breaker having a large breaking capacity and stable breaking performance by using a compact closing resistor unit having high performance.

It is another object of the present invention to provide a power resistor which has a large heat capacity per unit volume, an appropriate resistivity, a positive temperature coefficient of resistance having a small absolute value, and a sufficient surge breakdown.

According to the present invention, there is provided a power circuit breaker comprising:

main switching means arranged in a current path;

auxiliary switching means connected to the current path parallel with respect to the main switching means and turned on prior to an ON state of the main switching means; and a closing resistor unit connected in series with the auxiliary switching means and incorporated with a resistor having a sintered body consisting of a Zn—Ti—Co—O—based oxide and having metal components consisting of titanium calculates as titanium oxide ($TiO_2$) in an amount of 0.5 to 25 mol %, cobalt calculated as cobalt oxide (CoO) in an amount of 0.5 to 30 mol %, and Zn as substantially the balance.

In addition, according to the present invention, there is provided a power resistor comprising:

a sintered body consisting of a Zn—Ti—Co—O—based oxide and having metal components consisting of titanium calculated as titanium oxide ($TiO_2$) in an amount of 0.5 to 25 mol %, cobalt calculated as cobalt oxide (CoO) in an amount of 0.5 to 30 mol %, and Zn as substantially the balance; and electrodes formed on at least upper and lower surfaces of the sintered body.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

A power circuit breaker according to the present invention will be described below with reference to FIGS. 1 to 4.

Figure 1:
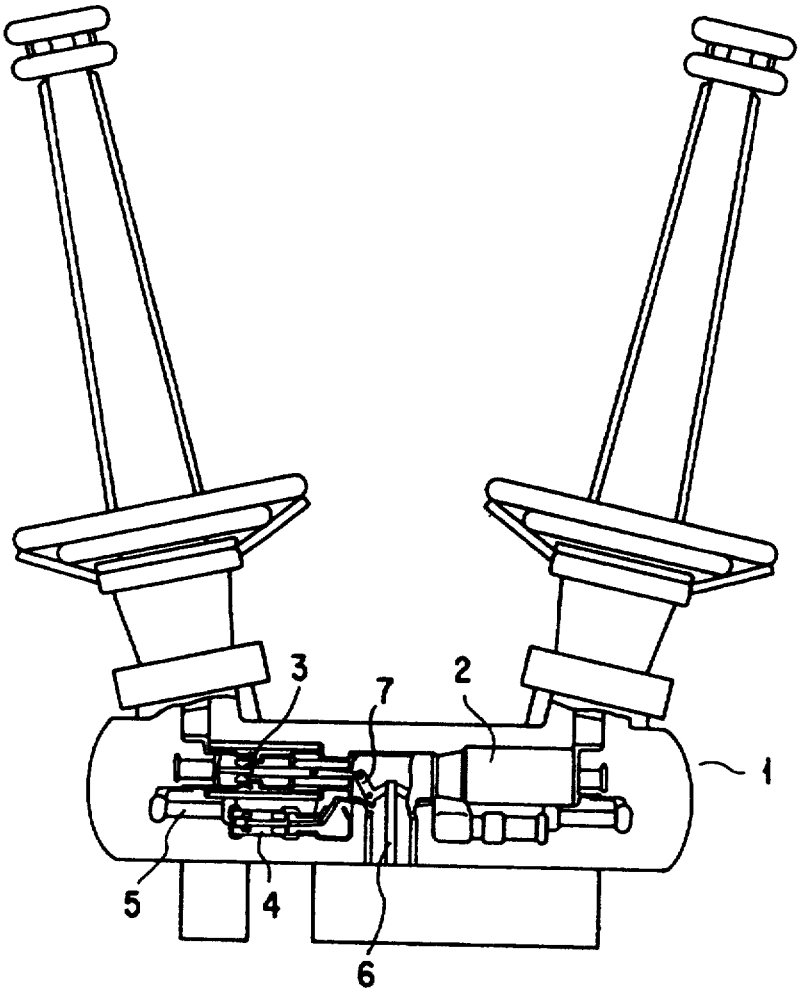
FIG. 1 is a view showing an arrangement of a power circuit breaker according to the present invention.
Figure 2:
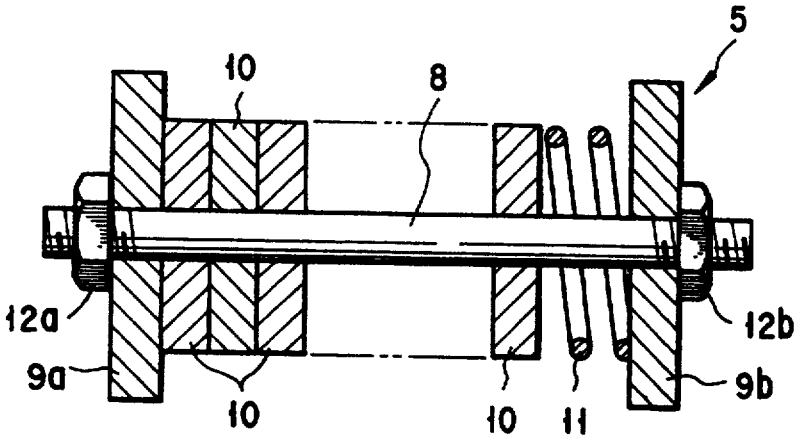
FIG. 2 is a view showing an arrangement of a closing resistor unit serving as a constituent element of the power circuit breaker in FIG. 1.

FIG. 1 is a view showing an arrangement of a circuit breaker according to the present invention, FIG. 2 is a perspective view showing a closing resistor. A circuit breaker 1 includes a main connection point 3 arranged in an arc extinguishing chamber 2 and connected to a current path. An auxiliary connection point 4 is connected to the current path parallelly with respect to the main connection point 3. A closing resistor unit 5 is connected in series with the auxiliary connection point 4. An insulating rod 6 which is vertically moved is connected to a switch 7 which is tilted.

In the power circuit breaker with the above arrangement, when the insulating rod 6 is driven upward, the switch 7 is tilted to turn on the auxiliary connection point 4 before the main connection point 3 is turned on. At this time, since the closing resistor unit 5 is connected in series with the auxiliary connection point 4, the voltage of a current flowing through the current path interposed with the auxiliary connection point 4 can be dropped to that of the closing resistor unit 5. As a result, an arc can be prevented from being generated in the ON state of the auxiliary connection point 4. In addition, a current flows in a current path interposed with the closing resistor unit 5 and the auxiliary connection point 4 immediately before the main connection point 3 is turned on, and no current flows in a current path interposed with the main connection point 3. For this reason, no high voltage is applied to the main connection point 3 when the main connection point 3 is turned on. As a result, an arc can be prevented from being generated in the ON state of the main connection point 3.

The closing resistor unit 5 is mainly constituted by an insulating support shaft 8, a pair of insulating support plates 9*a* and 9*b*, a plurality of hollow cylindrical resistors 10, and an elastic body 11, as shown in FIG. 2. The pair of conductive support plates 9*a* and 9*b* are fitted on the support shaft 8. The plurality of hollow cylindrical resistors 10 are fitted on the support shaft 8 located between the insulating support plates 9*a* and 9*b*. The elastic body 11 is disposed between the plurality of resistors 10 and the support plate 9*a* located at one end (right side). At the same time, the elastic body 11 is fitted on the insulating support shaft 8. The elastic body 11 applies an elastic force to the plurality of resistors 10 to stack them around the support shaft 8. Nuts 12*a* and 12*b* are threadably engaged with both the ends of the insulating support shaft 8, respectively. The nuts 12*a* and 12*b* are used for pressing the elastic body 11 arranged between the insulating support plates 9*a* and 9*b*. The insulating support shaft 8 is made of an organic material to have a high strength, a light weight, and good workability. The temperature of a closing resistor is generally increased during absorption of a switching surge. For this reason, the strength of the support shaft made of the organic material having a low heat resistance cannot easily be maintained. However, since a closing resistor having a composition (to be described later) has a large heat capacity, an increase in temperature of the resistor during absorption of a switching surge can be suppressed to a constant temperature or less. As a result, a support shaft made of the organic material can be used. In addition, as the heat capacity of a closing resistor is increased, the volume of the closing resistor can be decreased.

Figure 3:
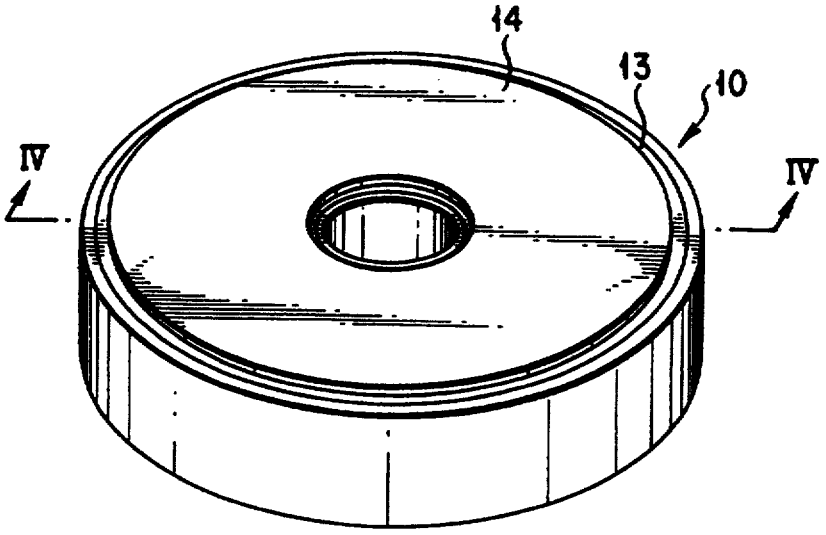
FIG. 3 is a perspective view showing a resistor incorporated in the closing resistor unit in FIG. 2.
Figure 4:
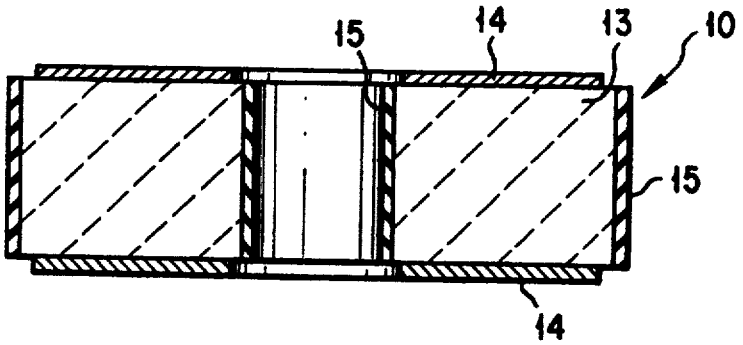
FIG. 4 is a sectional view showing the resistor along a line IV—IV in FIG. 3.

Each of the resistors 10 incorporated in the closing resistor unit 5 is constituted by an annular sintered body 13, electrodes 14 formed on the upper and lower surfaces of the sintered body 13, and insulating layers 15 coated on the outer and inner peripheral surfaces of the sintered body 13, as shown in FIGS. 3 and 4.

The sintered body 13 consists of a Zn—Ti—Co—O—based oxide and has a composition obtained such that metal components consist of titanium figured out as titanium oxide ($TiO_2$) in an amount of 0.5 to 25 mol %, cobalt figured out as cobalt oxide (CoO) in an amount of 0.5 to 30 mol %, and Zn as a substantially balance.

Figure 6:
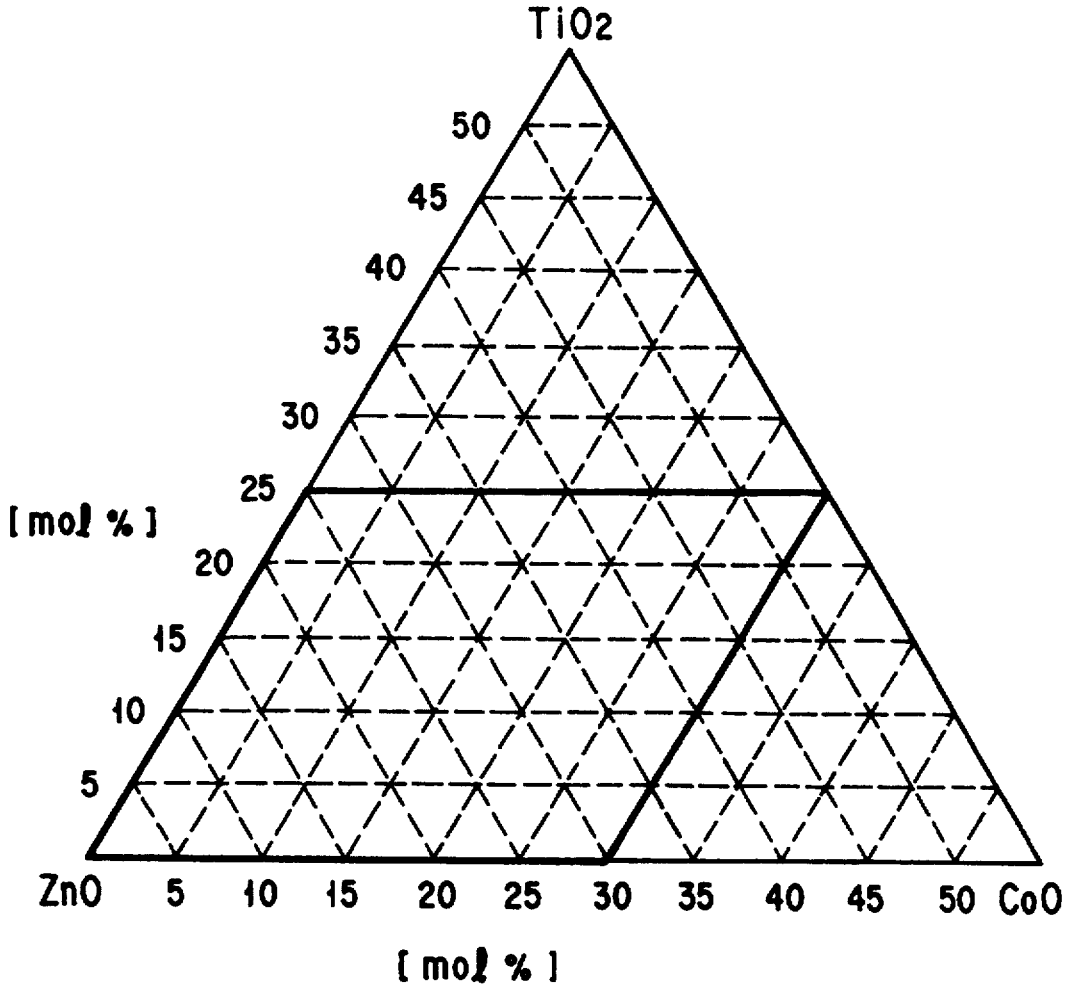
FIG. 6 is a diagram showing a component ratio of Zn, Co, and Ti in a sintered body used in a power resistor according to the present invention.

The ratio of Zn to Co to Ti serving as the metal components in the sintered body 13 is illustrated by an area surrounded by solid lines in the diagram of FIG. 6.

The proportions of the components of the sintered body 13 are limited as described above due to the following reasons.

When the sintered body contains titanium calculated as titanium oxide ($TiO_2$) in an amount of less than 0.5 mol %, the temperature coefficient of resistance has a negative value, and the absolute value of the temperature coefficient of resistance is increased. Therefore, a closing resistor having preferable characteristics cannot be obtained. On the other hand, when the sintered body contains titanium calculated as titanium oxide ($TiO_2$) in an amount of more than 25 mol %, the resistivity is increased to $10^4\Omega$·cm or more, and a closing resistor having preferable characteristics cannot be obtained. An amount of titanium calculated out as titanium oxide preferably falls within a range of 1 to 20 mol %.

When the sintered body contains cobalt calculated as cobalt oxide (CoO) in an amount of less than 0.5 mol %, the resistivity is about $10^2\Omega$·cm or less, and a closing resistor having preferable characteristics cannot be obtained. On the other hand, when the sintered body contains cobalt calculated as cobalt oxide (CoO) in an amount of more than 30 mol %, although a heat capacity per unit volume is increased, the resistivity is increased to $10^4\Omega$·cm or more, and a closing resistor having preferable characteristics cannot be obtained as described above. An amount of cobalt calculated as cobalt oxide preferably falls within a range of 1 to 20 mol %.

The sintered body 13 preferably includes a zinc oxide phase containing zinc oxide as a main component and a Spinel phase consisting of zinc, titanium, cobalt, and oxygen.

The zinc oxide phase consists of a zinc oxide (ZnO)-cobalt oxide (CoO) solid solution. More specifically, the zinc oxide phase is preferably a solid solution obtained by dissolving titanium calculated as titanium oxide ($TiO_2$) in an amount of 0.005 to 0.1 mol % in the zinc oxide (ZnO)-cobalt oxide (CoO) solid solution. When the sintered body including the zinc oxide phase obtained by dissolving titanium in the solid solution is used, a resistor having a small change in resistance caused by absorbing a surge can be realized.

The Spinel phase is represented by $(Zn_XCo_{1-X})_2TiO_4$ $(0<X<1)$.

The electrodes 14 are preferably made of a metal such as aluminum or nickel.

The insulating layers 15 are arranged to prevent a creepage discharge generated by the peripheral surfaces of the sintered body 13. The insulating layers 15 are preferably made of a resin, glass, or ceramic.

Each of the resistors 10 is manufactured by the following method.

A predetermined amount of titanium oxide powder and a predetermined amount of cobalt oxide powder are added to a zinc oxide powder, and they are sufficiently mixed in a ball mill together with water and a binder. The resultant mixture is dried, granulated, and molded to have an annular shape. At this time, a molding pressure is preferably set to be 200 kg/cm$^2$ or more to increase the density of the sintered body. When the molding is performed at a pressure of less than 200 kg/cm$^2$, the relative density of the sintered body is not increased, and a heat capacity of the sintered body per unit volume may be decreased. Subsequently, the molded body is sintered by an electric furnace or the like. This sintering can be performed in an oxide atmosphere such as in the air or an oxygen gas, and the sintering is preferably performed at a temperature of 1,000° C. to 1,500° C., and more preferably 1,300° C. to 1,500° C. When the sintering temperature is set to be less than 1,000° C., sintering is not performed, and the relative density may be decreased. As a result, the heat capacity of the resistor per unit volume is decreased, and a surge breakdown may be decreased. On the other hand, when the sintering temperature exceeds 1,500° C., the component element of the sintered body, especially a cobalt component, is considerably easily evaporated. Since variations in composition caused by the evaporation are conspicuous near the surface of the sintered body, a resistivity distribution is formed inside the sintered body. When the sintered body absorbs an energy to generate heat, a temperature distribution is formed, and the sintered body may be broken by a thermal stress.

when the solid solution amount of titanium in the zinc oxide-cobalt oxide solid solution of the sintered body is to be controlled, a temperature drop rate is set to be 20° to 300° C./hour while the temperature falls from 1200° to 900° C. during the calcining step, and rapid cooling (cooling in the furnace) is desirably performed when the temperature is decreased to 900° C. In this case, when the calcining temperature is high, the temperature drop rate is decreased, and a temperature at which the rapid cooling is started is desirably set to be low. The selection of the cooling pattern can control the solid solution amount of titanium in the zinc oxide-cobalt oxide solid solution within a predetermined range (0.005 to 0.1 mol %). However, conditions for the above process must be adjusted in consideration of the composition of the sintered body.

The upper and lower surfaces of the sintered body are polished, and electrodes made of aluminum or nickel are formed on the upper and the lower surfaces by sputtering, flame spraying, and baking, to obtain an oxide resistor. On the outer and inner peripheral surfaces of the resistor, resin or inorganic insulating layers (high-resistance layers) are formed by baking or flame spraying as needed.

It is sufficient that the resistor basically contains the above constituent components, and the resistor may contain other additives as needed to manufacture the resistor and to improve the characteristics of the resistor.

Figure 5:
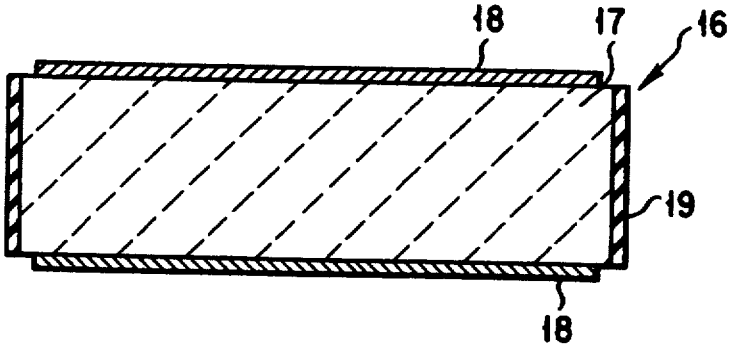
FIG. 5 is a sectional view showing another power circuit resistor according to the present invention.

In addition, although the structure of the resistor preferably has an annular shape, the structure is not limited to this shape. For example, as shown in FIG. 5, a resistor 16 may be constituted by a disk-like sintered body 17, electrodes 18 arranged on the upper and lower surfaces of the sintered body 17, and an insulating layer 19 covered on the outer peripheral surface of the sintered body 17.

A power resistor according to the present invention consists of a Zn—Ti—Co—O—based oxide and comprises a sintered body having a composition obtained such that metal components consist of titanium calculated as titanium oxide in an amount of 0.5 to 25 mol %, cobalt calculated as cobalt oxide in an amount of 0.5 to 30 mol %, and Zn as a substantially balance, and a pair of electrodes formed on the upper and lower surfaces of the sintered body. The resistor has a large heat capacity per unit volume, an appropriate resistivity, a positive temperature coefficient of resistance having a small absolute value, and a sufficient surge breakdown. More specifically, the temperature coefficient of resistance is positive due to the constituent phases of the sintered body.

That is, the constituent phases of the sintered body having the composition illustrated in the diagram of FIG. 6 are a zinc oxide phase consisting of a ZnO—CoO solid solution and a Spinel phase represented by, e.g., $(Zn_{1-X}Co_X)_2TiO_4$. For example, when the sintered body was analyzed by an X-ray diffractometer (XRD), in addition to a zinc oxide phase consisting of a ZnO—CoO solid solution, a Spinel phase represented by $(Zn_{1-X}Co_X)_2TiO_4$ was detected. In addition, when the structure of the sintered body was observed by an SEM having an energy dispersed X-ray spectrometer (EDX), it was confirmed that Spinel-phase grains containing titanium, cobalt, and zinc as constituent components were present in the grain boundary of grains in the zinc oxide phase. Therefore, it was confirmed that the sintered body had the constituent phases which were a zinc oxide phase consisting of a ZnO—CoO solid solution and a Spinel phase represented by, e.g., $(Zn_{1-X}Co_X)_2TiO_4$.

A resistor having the sintered body of the constituent phases, as described above, has a large heat capacitance per unit volume, an appropriate resistivity, a positive temperature coefficient of resistance having a small absolute value, and a sufficient surge breakdown. More specifically, it is assumed that the conductivity of the resistor considerably depends on the distribution state and amount of the zinc oxide phase.

In addition, in the resistor having the sintered body having the Spinel phase and the zinc oxide phase obtained by dissolving titanium in the ZnO—CoO solid solution, the temperature coefficient of resistance is always set to be positive when the amount of titanium calculated as titanium oxide is 0.005 mol % or more, and a rate of change in resistance is decreased when the amount of titanium is 0.1 mol % or less, thereby obtaining excellent characteristics. Dissolving the titanium in the zinc oxide phase to form a solid solution was confirmed such that grains in the zinc oxide and Spinel phases of the sintered body were separated, extracted, and chemically analyzed in the compositions of these grains.

In addition, a power circuit breaker according to the present invention comprises a closing resistor unit incorporated with a resistor having excellent characteristics and including a sintered body having the above composition. Since the closing resistor unit can be designed to have a small size and high performance, the breaking capacity of the breaker can be increased, and the power circuit breaker can have stable breaking performance and a small size.

The preferable examples of the present invention will be described below.

manufacturing 14 types of resistors shown in FIGS. 3 and 4.

In each of the resultant resistors, a resistivity at the room temperature, a temperature coefficient of resistance, and a specific heat were measured. The resistivity and the temperature coefficient of resistance were measured by a pseudo 4-terminal method such that small pieces each having a diameter of 10 nm and a thickness of 1 mm were cut from an outer surface, a central portion, and portions corresponding to the centers of the upper and lower surfaces, and aluminum electrodes were formed on the both sides of each of the pieces. The temperature coefficient of resistance was calculated by a rate of change per 1° C. in resistivity at room temperature and a rate of change per 1° C. in resistivity at a temperature of 100° C. The resultant values are described in Table 1.

TABLE 1

| No. | Content of CoO mol % | Content of $TiO_2$ mol % | Constituent Phase** | Resistivity Ω · cm | Temperature Coefficient of Resistance %/deg | Specific Heat J/cc · deg |
|---|---|---|---|---|---|---|
| 1* | 0.2 | 5 | z + s | 8 | 0.29 | 2.81 |
| 2 | 0.5 | 5 | z + s | 110 | 0.01 | 2.81 |
| 3 | 5 | 5 | z + s | 551 | 0.15 | 2.86 |
| 4 | 10 | 5 | z + s | 1740 | 0.25 | 2.92 |
| 5 | 15 | 5 | z + s | 2300 | 0.33 | 2.98 |
| 6 | 20 | 5 | z + s | 1910 | 0.21 | 3.04 |
| 7 | 30 | 5 | z + s | 7180 | −0.09 | 3.16 |
| 8* | 35 | 5 | z + s + c | 19100 | −0.31 | 3.23 |
| 9* | 5 | 0.3 | z + s | 12 | −0.50 | 2.86 |
| 10 | 5 | 0.5 | z + s | 120 | 0.05 | 2.86 |
| 11 | 5 | 10 | z + s | 570 | 0.19 | 2.87 |
| 12 | 5 | 15 | z + s | 700 | 0.34 | 2.87 |
| 13 | 5 | 25 | z + s | 6620 | 0.48 | 2.88 |
| 14* | 5 | 30 | z + s | 28700 | 0.71 | 2.88 |

*: Nos. 1, 8, 9 and 14 represent the Referential Example.
**(Constituent phases): Z represents a ZnO phase, S represents a Spinel Phase, and C represents a CoO phase.

Resistor Manufacturing Examples 1–14

A zinc oxide (ZnO) powder having an average grain size of 0.7 μm, a cobalt oxide (CoO) powder having an average grain size of 0.5 μm, and a titanium oxide ($TiO_2$) powder having an average grain size of 0.7 μm were prepared in the proportions in Table 1, and were mixed with distilled water in a wet state for 24 hours using a resin ball mill and a zirconium grinding medium. Each of the resultant slurrys was dried, mixed with a predetermined amount of a polyvinyl alcohol aqueous solution serving as a binder, and granulated through a screen to form a granulated powders. Each of the granulated powders was molded by a metal mold at a pressure of 500 kg/cm$^2$ to form an annular molded bodies having an outer diameter of 148 mm, an inner diameter of 48 mm, and a height of 32 mm. After the binder in the molded bodies was removed, each of the molded bodies was placed in an aluminum vessel, and its temperature was increased at a rate of 100° C./hour, thereby sintering the molded body at a temperature of 1,400° C. in the air for 2 hours. A borosilicate glass powder was coated on the outer and inner peripheral surfaces of the sintered bodies and baked to form insulating layers thereon. The upper and lower surfaces (annular surfaces) of the sintered bodies were polished to form a sintered bodies having an outer diameter of 127 mm, an inner diameter of 31 mm, and a height of 25.4 mm, respectively. After each of the resultant sintered bodies was washed, aluminum electrodes were formed on the upper and lower surfaces by flame spraying, thereby As is apparent from Table 1, resistivities fell within a range of $10^2$ to $10^4$Ω·cm in the resistor Nos. 2 to 7 and Nos. 10 to 13 each of which had a sintered body consisting of a Zn—Ti—Co—O—based oxide and having a composition range in which metal components consisted of titanium calculated as titanium oxide ($TiO_2$) in an amount of 0.5 to 25 mol %, cobalt calculated as cobalt oxide (CoO) in an amount of 0.5 to 30 mol %, and Zn as a balance. In addition, it was found that the absolute value of the temperature coefficient of resistance was 0.5 or less in each of the resistor Nos. 2 to 7 and Nos. 10 to 13 and that all the temperature coefficients of resistances in these resistors except for the resistor No. 7 were positive. In addition, it was found that each of the resistor Nos. 2 to 7 and Nos. 10 to 13 had a specific heat falling within a range of 2.81 to 3.16 J/cm$^3$ greater than the specific heat (2.0 J/cm$^3$) of a conventional resistor using carbon grain dispersion ceramic as a sintered body.

In contrast to this, in a resistor (No. 1) having a sintered body containing CoO in an amount of less than 0.5 mol %, a resistivity was decreased to $10^2$Ω·cm or less. On the other hand, in a resistor (No. 8) having a sintered body containing CoO in an amount of more than 30 mol %, it was found that a resistivity was $10^4$Ω·cm or more, and a CoO phase was produced to set the temperature coefficient of resistance to be negative.

In addition, in a resistor (No. 9) having a sintered body containing $TiO_2$ in an amount of less than 0.5 mol %, a temperature coefficient of resistance was negative and had a large absolute value, and a rate of change in resistivity was increased. On the other hand, a resistor (No. 14) having a sintered body containing $TiO_2$ in an amount of more than 25 mol %, it was found that a resistivity was $10^4\Omega$·cm or more.

Examples 1-10

A predetermined number of the resistor samples of each of resistor Nos. 2 to 7 and Nos. 10 to 13 and a predetermined number of samples of each of carbon grain dispersion ceramic resistors (comparative examples) were stacked as shown in FIG. 2, and the resultant resistors were supported, as the resistors 10 in FIG. 2, by an elastic member and an insulating support shaft 8 made of a resin and extending through the central portions of the resistors. Each of the resultant structures was accommodated in a cylindrical vessel to obtain a closing resistor units. Each of the closing resistor units was incorporated as shown in FIG. 1 to assemble power circuit breakers. Each of the resistors of the Comparative Examples had a resistivity of 500Ω·cm, a resistance of 11.4Ω, and a heat capacity of 2.0 J/cm$^3$·deg.

In each of the circuit breakers of Examples 1 to 10 and the Comparative Examples, an energy corresponding to the energy of the circuit breaker in out-of-step Relay conditions was applied to each of resistors of the circuit breaker, and an energy (energy breakdown) capable of applying the resistor whose temperature was increased within 80° C. was measured. In addition, a volume reduction ratio of each of the circuit breakers of Examples 1 to 10 was measured with respect to that of each of the circuit breakers of the Comparative Examples. The obtained results are described in Table 2.

TABLE 2

| | Type of Resistor | Energy Breakdown of Resistor J/cm$^3$ | Reduction Ratio of Volume of Circuit Breaker % |
|---|---|---|---|
| Comparative Example | Carbon Grain Dispersion Type | 160 | — |
| Example 1 | No. 2 in Table 1 | 750 | 90.3 |
| Example 2 | No. 3 in Table 1 | 760 | 90.2 |
| Example 3 | No. 4 in Table 1 | 780 | 90.0 |
| Example 4 | No. 5 in Table 1 | 790 | 89.8 |
| Example 5 | No. 6 in Table 1 | 800 | 89.6 |
| Example 6 | No. 7 in Table 1 | 830 | 89.3 |
| Example 7 | No. 10 in Table 1 | 760 | 90.3 |
| Example 8 | No. 11 in Table 1 | 760 | 90.1 |
| Example 9 | No. 12 in Table 1 | 770 | 90.1 |
| Example 10 | No. 13 in Table 1 | 770 | 90.0 |

In addition, in order to examine the stability of breaking performance, an energy corresponding to the energy of a circuit breaker in out-of-step Relay conditions was applied 20 times to each of the circuit breakers of Examples 1 to 10, and the rate of change in resistivity of each of the closing resistors was measured. As a result, in each of all the circuit breakers, the rate of change in resistivity was 10% or less, and it was confirmed that the stability of the breaking performance was sufficiently high.

Resistor Manufacturing Examples 15-34

A zinc oxide (ZnO) powder having an average grain size of 0.2 μm, a cobalt oxide (CoO) powder having an average grain size of 0.5 μm, and a titanium oxide ($TiO_2$) powder having an average grain size of 0.7 μm were prepared in the proportions described in Table 3, and were mixed with distilled water in a wet state for 24 hours using a resin ball mill and a zirconium grinding medium. Each of the resultant slurrys was dried, mixed with a predetermined amount of a polyvinyl alcohol aqueous solution serving as a binder, and granulated through a screen to form a granulated powders. Each of the granulated powders was molded by a metal mold at a pressure of 500 kg/cm$^2$ to form an annular molded bodies having an outer diameter of 148 mm, an inner diameter of 48 mm, and a height of 32 mm. After the binder in the molded bodies was removed, each of the molded bodies was placed in an aluminum vessel and sintered in the air for 2 hours. Sintering temperatures, temperature drop rates, cooling start temperatures in the above processes are described in Table 3. Thereafter, cooling was rapidly performed in a furnace.

A borosilicate glass powder was coated on the outer and inner peripheral surfaces of each of the resultant sintered bodies and baked to form insulating layers. Subsequently, the upper and lower surfaces of each of the sintered bodies were polished such that each of the sintered bodies had an outer diameter of 127 mm, an inner diameter of 31 mm, and a height of 25.4 mm. After each of the sintered bodies was washed, aluminum electrodes were formed on the upper and lower surfaces by flame spraying, thereby manufacturing 15 types of resistors shown in FIGS. 3 and 4.

TABLE 3

| No. | Content of CoO mol % | Content of $TiO_2$ mol % | Sintering Temperature (°C.) | Temperature Drop Rate (°C./h) | Cooling Temperature |
|---|---|---|---|---|---|
| 15 | 5 | 15 | 1400 | 100 | 1300 |
| 16 | 5 | 15 | 1400 | 100 | 1200 |
| 17 | 5 | 15 | 1400 | 100 | 1100 |
| 18 | 5 | 15 | 1400 | 100 | 1000 |
| 19 | 5 | 15 | 1400 | 100 | 900 |
| 20 | 5 | 15 | 1300 | 100 | 900 |
| 21 | 5 | 15 | 1200 | 100 | 900 |
| 22 | 5 | 5 | 1400 | 100 | 1200 |
| 23 | 5 | 5 | 1400 | 100 | 1100 |
| 24 | 5 | 5 | 1400 | 100 | 1000 |
| 25 | 5 | 5 | 1400 | 100 | 900 |
| 26 | 5 | 5 | 1400 | 100 | 800 |
| 27 | 5 | 5 | 1400 | 300 | 1000 |
| 28 | 5 | 5 | 1400 | 200 | 1000 |
| 29 | 5 | 5 | 1400 | 50 | 1000 |
| 30 | 5 | 5 | 1400 | 20 | 1000 |
| 31 | 5 | 5 | 1400 | 10 | 1000 |
| 32 | 5 | 10 | 1400 | 100 | 1200 |
| 33 | 5 | 7 | 1400 | 100 | 1200 |
| 34* | 5 | 0.3 | 1400 | 100 | 1200 |

*: No. 34 represents the Referential Example.

The Ti composition (content of Ti calculated as $TiO_2$) in the ZnO—CoO solid solutions of the sintered bodies manufactured in Resistor Manufacturing Examples 15 to 34 were separated and extracted, and the contents of the Ti composition were measured by chemical analysis. That is, each of the sintered bodies was ground to form a powder sample, and 50 ml of a solution mixture consisting of 5% acetic acid and 5% lactic acid were added to 1 g of the sample powder. After ZnO grains were dissolved while an ultrasonic wave was applied to the sample powder for 90 minutes, the dissolved grains were filtered with a filter, and titanium was quantitatively measured by ICP (Inductively Coupled Plasma spectrometry) emission spectroscopy. In each of the resultant resistors, a resistivity at room temperature, a temperature coefficient of resistance, and a rate of change in resistance were examined. Note that the temperature coefficient of resistance was evaluated in the same method as described in Resistor Manufacturing Example 1. The rate of change in resistance was obtained such that a change in resistance obtained when a shock wave corresponding to 200 J/cm$^3$ was applied 20 times to a sample having a diameter of 20 mm cut from each of resistors was calculated as a percentage to an initial value. The resultant values are described in Table 4.

TABLE 4

| No. | Content of $TiO_2$ in ZnO Phase mol % | Resistivity (Ω · cm) | Temperature Coefficient of Resistance (%/deg) | Rate of Change in Resistance (%) |
|---|---|---|---|---|
| 15 | 0.130 | 560 | 0.50 | −18 |
| 16 | 0.090 | 580 | 0.43 | −7 |
| 17 | 0.080 | 590 | 0.36 | −5 |
| 18 | 0.070 | 610 | 0.32 | −4 |
| 19 | 0.070 | 620 | 0.29 | −5 |
| 20 | 0.050 | 740 | 0.37 | −6 |
| 21 | 0.050 | 810 | 0.41 | −8 |
| 22 | 0.018 | 480 | 0.31 | −6 |
| 23 | 0.012 | 490 | 0.28 | −5 |
| 24 | 0.008 | 510 | 0.20 | −5 |
| 25 | 0.005 | 530 | 0.11 | −7 |
| 26 | 0.003 | 570 | −0.39 | −16 |
| 27 | 0.013 | 470 | 0.33 | −7 |
| 28 | 0.010 | 480 | 0.30 | −8 |
| 29 | 0.007 | 520 | 0.24 | −8 |
| 30 | 0.006 | 540 | 0.08 | −9 |
| 31 | 0.003 | 550 | −0.45 | −15 |
| 32 | 0.100 | 580 | 0.19 | −8 |
| 33 | 0.050 | 430 | 0.26 | −5 |
| 34* | 0.002 | 12 | −0.50 | −22 |

*: No. 34 represents the Referential Example.

A resistor used as a closing resistor preferably has the following values. That is, a resistivity is $10^2$ to $10^4$Ω·cm, a temperature coefficient of resistance has a positive value and an absolute value of 0.5% or less, and a rate of change in resistance caused by surge absorption is 10% or less. As is apparent from Table 4, in each of resistors (Nos. 16 to 25, Nos. 27 to 30, and Nos. 32 and 33) each having a sintered body in which $TiO_2$ dissolved in a ZnO—CoO solid solution in an amount of 0.005 to 0.1 mol %, a temperature coefficient of resistance has a positive value and a small absolute value, and a rate of change in resistance caused by repetitive surge application is low.

Examples 11–17

A predetermined number of the resistor samples of each of resistor Nos. 16, 18, 20, 23, 27, 30, and 32 were stacked as shown in FIG. 2, and the resultant resistors were supported, as the resistors 10 in FIG. 2, by an elastic member 11 and an insulating support shaft 8 made of a resin and extending through the central portions of the resistors. Each of the resultant structures was accommodated in a cylindrical vessel to obtain a closing resistor units. Each of the closing resistor units was incorporated as shown in FIG. 1 to assemble power circuit breakers.

In each of the circuit breakers of Examples 11 to 17, an energy corresponding to the energy of the circuit breaker in out-of-step Relay conditions was applied to each of the resistors of the circuit breakers, and an energy (energy breakdown) capable of applying the resistor whose temperature was increased within 80° C. was measured. In addition, a volume reduction ratio of each of the circuit breakers of Examples 11 to 17 with respect to that of the circuit breaker of the Comparative Example. The resultant values are described in Table 5. The energy breakdown of the Comparative Example as described above is also described in Table 5.

TABLE 5

| | Type of Resistor | Energy Breakdown of Resistor J/cm$^3$ | Reduction Ratio of Volume of Circuit Breaker % |
|---|---|---|---|
| Comparative Example | Carbon Grain Dispersion Type | 160 | — |
| Example 11 | No. 16 in Table 4 | 770 | 90.1 |
| Example 12 | No. 18 in Table 4 | 770 | 90.1 |
| Example 13 | No. 20 in Table 4 | 770 | 90.1 |
| Example 14 | No. 23 in Table 4 | 760 | 90.2 |
| Example 15 | No. 27 in Table 4 | 760 | 90.2 |
| Example 16 | No. 30 in Table 4 | 760 | 90.2 |
| Example 17 | No. 32 in Table 4 | 760 | 90.1 |

In addition, in order to examine the stability of breaking performance, an energy corresponding to the energy of a circuit breaker in out-of-step Relay conditions was applied 20 times to each of the circuit breakers of Examples 11 to 17, and the rate of change in resistivity of each of the closing resistors was measured. As a result, in each of all the circuit breakers, the rate of change in resistivity was 10% or less, and it was confirmed that the stability of the breaking performance was sufficiently high.

As described above, according to the present invention, there is provided a power circuit breaker including a closing resistor unit having a large heat capacity. The power circuit breaker can absorb a large switching surge and has dimensions smaller than those of a power circuit breaker which can absorb the same switching surge as described above. In addition, the closing resistor unit has a small temperature coefficient, and the power circuit breaker of the present invention has stability to repetitive energy application.

As described above, according to the present invention, there is provided a power resistor having a large heat capacity per unit volume, an appropriate resistivity, a temperature coefficient of resistance having a positive value and a small absolute value, and a sufficient surge breakdown. Therefore, the dimensions of the resistor can be considerably smaller than those of a conventional resistor, and a circuit breaker incorporated with the resistor can be designed to have small dimensions. In addition, when the resistor is applied to other power equipments such as an NGR and a motor control resistor, the dimensions of the power equipments can be decreased.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A power circuit breaker, comprising:

main switching means arranged in a circuit path;

auxiliary switching means connected to said circuit path in parallel with said main switching means and turned on prior to an ON state of said main switching means; and a closing resistor unit connected in series with said auxiliary switching means;

wherein said closing resistor unit comprises a sintered body and electrodes formed on at least upper and lower surfaces of said sintered body, said sintered body including zinc oxide and titanium oxide in an amount of 0.5 to 25 mol % and cobalt oxide in an amount of 0.5 to 30 mol %, said sintered body containing a zinc oxide phase in the form of a zinc oxide-cobalt oxide solid solution containing 0.005 to 0.1 mol % of titanium oxide and a spinel phase consisting of zinc, titanium, cobalt and oxygen.

2. A breaker according to claim 1, wherein the zinc oxide phase consists of a zinc oxide (ZnO)-cobalt oxide (CoO) solid solution.

3. A breaker according to claim 1, wherein the Spinel phase is represented by $(Zn_XCo_{1-X})_2TiO_4$ $(0<X<1)$.

4. A power resistor, comprising:

a sintered body including zinc oxide and titanium oxide in an amount of 0.5 to 25 mol % and cobalt oxide in an amount of 0.5 to 30 mol %, said sintered body containing a zinc oxide phase in the form of a zinc oxide-cobalt oxide solid solution containing 0.005 to 0.1 mol % of titanium oxide and a spinel phase consisting of zinc, titanium, cobalt, and oxygen; and electrodes formed on at least upper and lower surfaces of said sintered body.

5. A resistor according to claim 4, wherein the zinc oxide phase consists of a zinc oxide (ZnO)-cobalt oxide (CoO) solid solution.

6. A resistor according to claim 2, wherein the Spinel phase is represented by $(Zn_XCo_{1-X})_2TiO_4$ $(0<X<1)$.

7. A resistor according to claim 2, wherein said electrodes are made of aluminum.

8. A resistor according to claim 2, wherein an outer peripheral surface of said sintered body except for said electrodes is covered with an insulating layer.

9. A resistor according to claim 8, wherein said insulating layer is made of glass.

10. A resistor according to claim 9, wherein the glass is borosilicate glass.

11. A power resistor according to claim 4, wherein said sintered body contains titanium oxide in an amount of 1 to 20 mol % and cobalt oxide in an amount of 1 to 20 mol %.

* * * * *